United States Patent [19]

Bayham

[11] 4,098,456

[45] Jul. 4, 1978

[54] CENTRIFUGE SYSTEM HAVING COLLAPSIBLE CENTRIFUGE BAGS

[75] Inventor: Edward L. Bayham, Mundelein, Ill.

[73] Assignee: Baxter Travenol Laboratories, Inc., Deerfield, Ill.

[21] Appl. No.: 782,488

[22] Filed: Mar. 29, 1977

[51] Int. Cl.[2] ..... B04B 15/12

[52] U.S. Cl. ..... 233/14 R; 233/26

[58] Field of Search ..... 233/1 R, 1 A, 1 D, 14 R, 233/14 A, 26, 27; 128/2 F, 214 D, DIG. 5, 194

[56] References Cited

U.S. PATENT DOCUMENTS

| | | | |
|---|---|---|---|
| 3,545,671 | 12/1970 | Ross | 233/26 |
| 3,561,672 | 2/1971 | Schlutz et al. | 233/26 X |
| 3,672,564 | 6/1972 | Schlutz et al. | 233/26 |
| 3,674,197 | 7/1972 | Mitchell et al. | 233/14 R |
| 4,012,471 | 3/1977 | Kunkle | 128/194 |

FOREIGN PATENT DOCUMENTS

| | | | |
|---|---|---|---|
| 1,428,373 | 3/1976 | United Kingdom | 128/214 D |

*Primary Examiner*—George H. Krizmanich
*Attorney, Agent, or Firm*—Henry W. Collins; Paul C. Flattery; Garrettson Ellis

[57] ABSTRACT

A centrifuge cup, having a mouth-defining rim, carries a pair of separable cap member halves positioned together at the rim of the centrifuge cup, to define a cap over the mouth of the cup. Means, associated with the cap member halves, are provided for gripping the upper end of a flexible bag positioned in the cup, to prevent its collapse upon centrifugation. The flexible bag contains an inlet and an outlet, plus a third, sealed access port for access to blood cells after centrifugation, and a hanger member to permit the bag to be hung upside down in dispensing position.

12 Claims, 12 Drawing Figures

FIG. 1
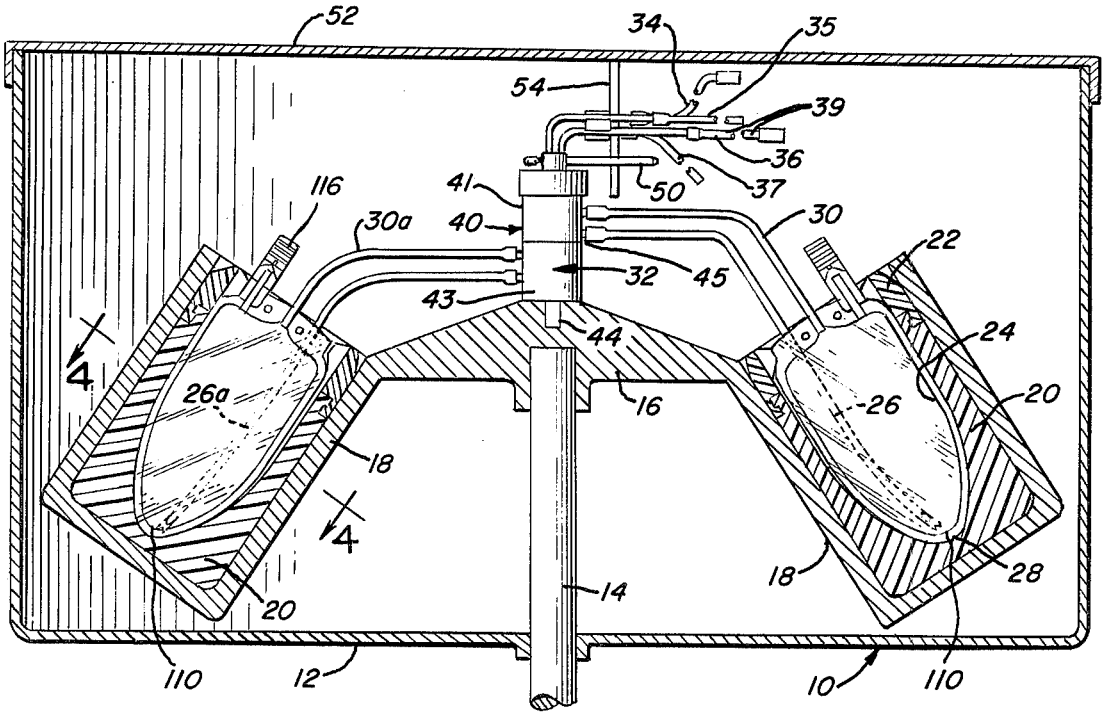
FIG. 3
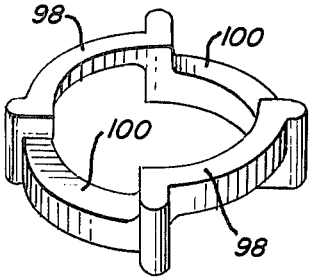
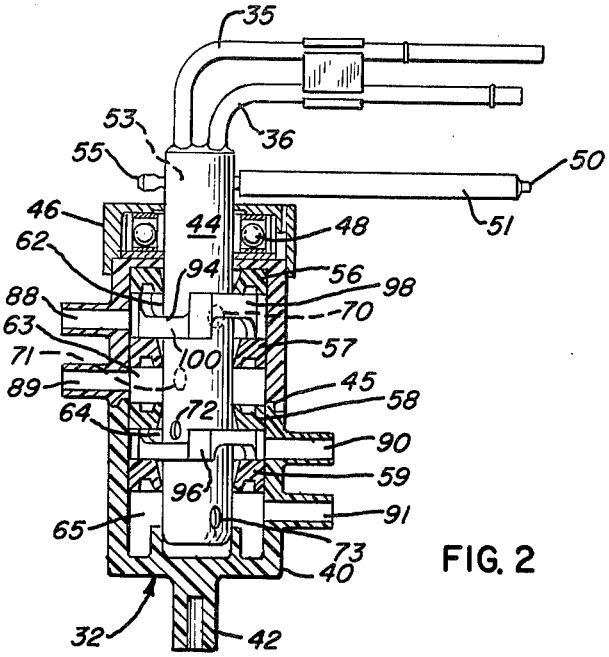
FIG. 2

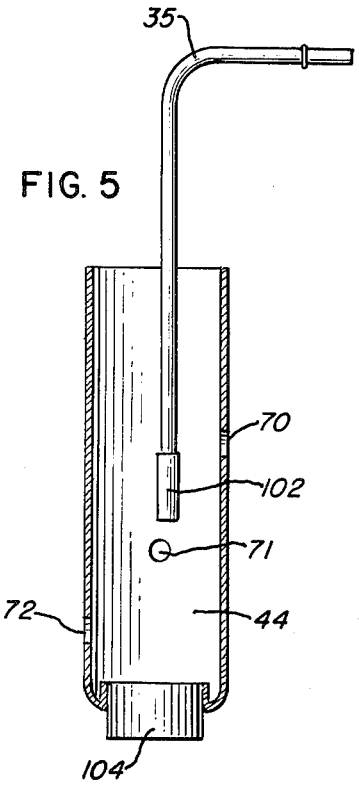
FIG. 5
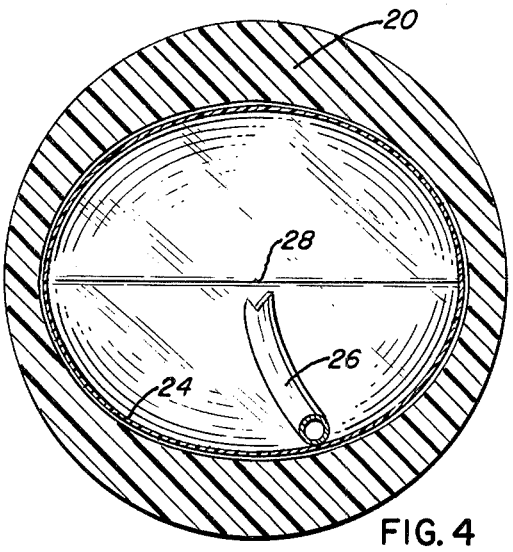
FIG. 4
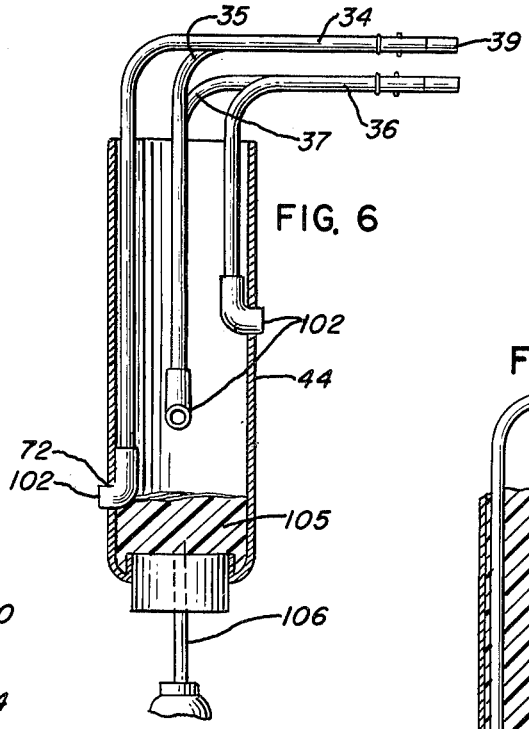
FIG. 6
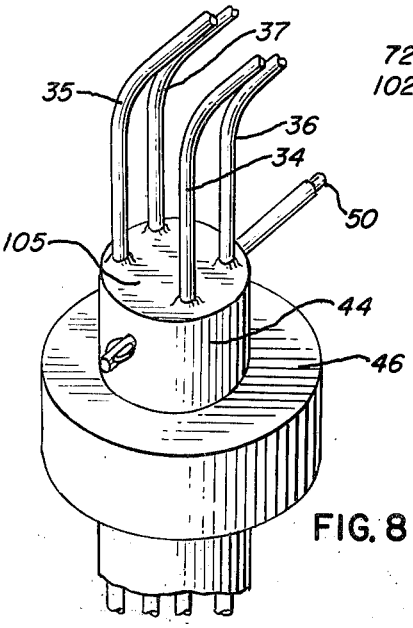
FIG. 8
FIG. 7
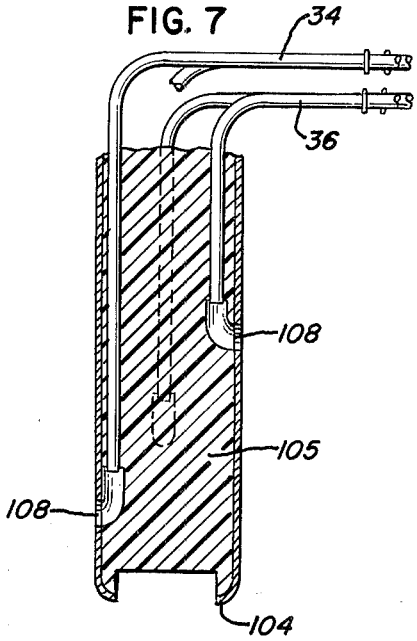

CENTRIFUGE SYSTEM HAVING COLLAPSIBLE CENTRIFUGE BAGS

BACKGROUND OF THE INVENTION

In U.S. Pat. Nos. 3,347,454; 3,672,564; and 3,719,406, centrifuges are disclosed utilizing collapsible centrifuge bags for the continuous washing of blood cells positioned in the bags during the centrifuge operation. To provide a continuous connection with the exterior while the centrifuge is rotating, a rotary seal distributor member is disclosed including an apertured spindle coaxially mounted in a housing and projecting from its end, with several spaced ring seals positioned about the spindle. The annular spaces which are defined by the ring seals serve as separate chambers through which fluid flows either into or out of the system. For example, two separate washing systems may be routed through the same rotary seal structure, as illustrated in the last-cited patent.

The flexible, collapsible centrifuge bags are particularly desirable for washing blood and separating blood components, since they can be collapsed flat by suction to completely empty without the use of an excess of washing solution to remove the blood cells.

It is of course desirable for the bags to be manufacturable in the most economical and efficient manner possible, which generally is to manufacture them in flat configuration by heat sealing a pair of sheets of plasticized polyvinylchloride or other appropriate plastic together at their periphery to define the bag. At the same time, when the bag is expanded in the centrifuge cup, it is desirable for a minimum of wrinkles to be present in the bag, which wrinkles tend to retain the blood cells and interfere with washing and separation process.

Also, it is desirable to provide means to prevent the radially outwardly collapse of the flexible collapsible container utilized herein, so that the containers do not crush down into the centrifuge cup upon centrifugation.

It is also desirable to utilize a collapsible centrifuge bag which can also serve as a blood bag for administration of its contents to a patient, so that a transfer of the contents from the centrifuge bag to a separate blood bag is unnecessary.

DESCRIPTION OF THE INVENTION

In accordance with this invention, there is provided with a centrifuge cup having a mouth-defining rim, a pair of separable cup member halves being carried at the rim of the centrifuge cup and positioned together to define a cap over its mouth. Means, associated with the cap member halves, are provided for gripping the upper end of a flexible bag positioned in the cup, to prevent the bag from collapsing in the cup upon centrifugation. This is generally accomplished by pins carried by the cap member halves, and proportioned to pass through a flexible bag adjacent its upper end while the bag is positioned in the centrifuge cup.

Also, the cap member halves preferably define means for removable interlocking connection with the rim of the cap.

Each cap member half may carry the pin means in such a position as to be adapted for passing into a socket of the mating cap member half.

The collapsible centrifuge bag is generally flat in its initial configuration, defining an interior which is generally parabolic in shape at one end. The parabolic end is generally placed at the inner end of the centrifuge cup so that it occupies a radially-outward rotary position. An inlet and outlet tube pass in sealed manner into the bag at the end opposite to the parabolic end. The inlet tube extends into the bag interior and terminates adjacent the parabolic end, while the outlet typically terminates immediately upon establishing communication with the bag interior. The bag also includes a third, sealed access port at the end opposite to the parabolic end for access to blood cells after centrifugation and washing. A hanger member at the parabolic end is also provided, so the centrifuge bag can be utilized as a blood bag, thus avoiding the transfer of blood cells from one bag to another.

In the drawings,

FIG. 1 is an elevational view of part of a centrifuge system, utilizing the centrifuge cup and collapsible bag arrangement of this invention.

FIG. 2 is an enlarged, partial longitudinal sectional view of a rotary distributor seal which may be used in this invention.

FIG. 3 is a perspective view of the rigid ring support member in the rotary seal used herein.

FIG. 4 is a sectional view taken along line 4—4 of FIG. 1.

FIG. 5 is a sectional view of the spindle used in the rotary seal, shown in an initial stage of construction.

FIGS. 6 and 7 are sectional views which show consecutive steps in the manufacture of the spindle utilized in a specific embodiment of this invention.

FIG. 8 is a perspective view of the upper portion of the completed spindle utilized herein.

Figure 9:
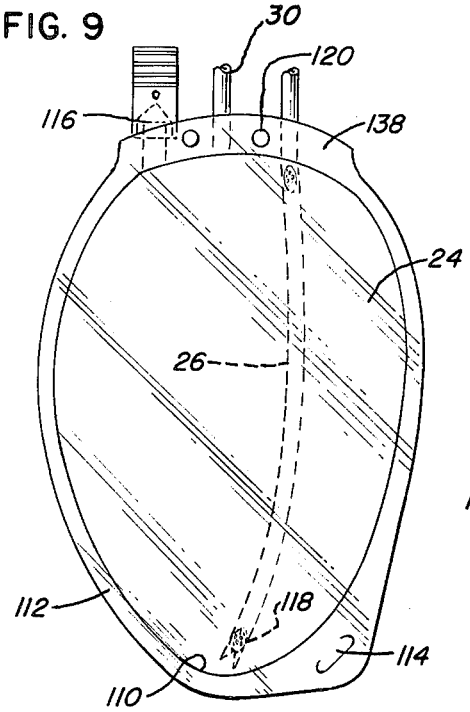
FIG. 9 is an elevational view of the collapsible centrifuge bag used in this invention.

Referring to FIG. 1, a centrifuge 10 is shown comprising a housing 12, a rotating shaft 14, and cross arm 16 which carries a plurality of centrifuge cups 18, specifically two cups in the particular instance shown.

Centrifuge 10 may be of the general purpose type, but is specifically adapted for washing of blood by means of the apparatus described below.

Each centrifuge cup 18 is shown to be holding an inner cup 20 which, in turn, carries a cap member 22 on its mouth end. Within the cup and cap member is a collapsible plastic bag 24 for receiving blood cells for washing. A pair of flow tubes pass through the periphery of bag 12 into communication with the interior thereof. Flow inlet tubes 26, **26*a* extend essentially the length of the interior of the bag to open near the radially-outward apex 28, while flow tubes 30, 30*a*** terminate at the radially-inward end of the bag.

Rotary seal 32 is provided to permit the continuous distribution of fluid to the centrifuging system from tubing 34, 35, 36 and 37 to provide four independent, separate flow paths through the rotary seal between tubes 34 through 37 and tubes 26, **26*a*, 30 and 30*a***.

Referring to FIGS. 2 and 3, rotary seal 32 is shown in greater detail.

Rotary seal member 32 is shown to define a tubular housing 40 having a lower protrusion 42 which may be rectangular in shape or of other non-circular cross section, to fit in a mating hole of the centrifuge cross arm 16 so that housing member 40 rotates with the centrifuge.

Housing 40 may be made of a pair of tubular members 41, 43 which abuts together at annular, stepped junction 45 as shown.

Seal member 32 also defines spindle 44, which is secured to cap 46 in rotational manner by means of a ball bearing 48. Cap 46 in turn is secured to housing 40, so that the housing 40 and spindle 44 are in relatively rotating relationship.

The upper end of spindle 44 carries a cross bar 50 which may pass through the spindle. Cross bar 50 carries protective sleeve 51, which also serves as a retention means to prevent bar 50 from sliding through aperture 53 of spindle 44. At the other end, bar 50 has a flattened head 55 produced by cold heading or the like to cause the bar to be retained in aperture 53.

Casing 12 carries a cross member 52 across its top which, in turn, carries a depending member 54 positioned to engage cross bar 50. Thus, as the centrifuge begins to rotate, cross bar 50 engages depending member 54, preventing the rotation of spindle 44.

A plurality of ring seals 56, 57, 58 and 59 are positioned between spindle 44 and the inner surface of housing 40, to provide seals about spindle 44, and to subdivide the annular space between spindle 44 and housing 40 into a plurality of separate chambers 62, 63, 64 and 65, which chambers are sealed from each other by the ring seals. Positioned to communicate with each chamber are apertures 70, 71, 72 and 73, to provide communication between the interior of the spindle and each separate annular chamber. One each of tubes 34, 35, 36 and 37 communicate in a sealed manner to be described below with each of the apertures 70 through 73, to provide four independent flow paths through spindle 44.

Ports 88, 89, 90, and 91 provide communication through the lateral wall of housing 40, each to a separate annular chamber 62 through 65, so that each of the ports 88 through 91 represents an extension of the independent flow paths described above. Tubes **26, 26*a*, 30 and 30*a* communicate with ports 88 through 91 to provide an extension of the four independent flow paths, two leading to centrifuge bag 24, and two others leading to centrifuge bag 24*a***, one each for use as a fluid inlet and the others for fluid outlets.

Support members 94, 96 are positioned in alternate, spaced chambers 62, 64 between a pair of ring seals to prevent collapse of the ring seal pairs together.

Thus, chambers 63 and 65 may be part of the respective fluid inlet lines, being in flow communication respectively with inlet tubes **26, 26*a*. These chambers will be expected to exhibit a higher pressure during operation than the pressure in outlet chambers 62, 64, which are in flow communication with outlet lines 30, 30*a*. The presence of support members 94, 96 prevents the undue stretching and collapsing of, respectively, ring seals 56 and 57 and ring seals 58 and 59** together with the resultant possibility of seal failure and cross mixing of the contents of the respective annular chambers.

Support members 94, 96 comprise a rigid ring positioned about spindle 44 and preferably spaced from it. A first opposed pair of sections 98 of members 94, 96 occupies a first plane which is generally transverse to the axis of spindle 44. A second opposed pair of sections 100 of members 94, 96 is spaced between the first pair of sections 98, and occupies a second transverse plane, to provide a structure which simultaneously supports the ring seals between which it is placed, while permitting flow of fluid around and through the support members, so that annular chambers 62, 64 are not occluded.

FIGS. 5 through 8 show successive steps of the assembling of tubes 34 through 37 in the spindle 44. The major portions of tubes 34 through 37 are rigid, being preferably made of stainless steel, ABS plastic, or the like, although they may be connected to flexible tubing 39 at their ends.

The problem is to insert the tube such as tube 35 longitudinally into the hollow spindle 44, and then to make a sealing connection with an aperture (for example aperture 72) which involves making an angled turn and sealing.

This is accomplished by means of flexible sleeve 102, which is placed on the end of the tube 35 as shown in FIG. 5. Sleeve 102 may be made of polyvinyl chloride plastisol. Thereafter, tube 35 is inserted into spindle 44, and elastic tube 102 is drawn through aperture 72 as shown in FIG. 6. This process is repeated for each of the tubes 34 through 37, after which the interior of spindle 44 is filled through bottom aperture 104 with a potting compound such as room temperature vulcanizable silicone elastomer 105, as shown in FIG. 7, using a syringe 106. Then a plug may be inserted in aperture 104, at least until elastomer 105 is cured.

After curing of the potting compound, the flexible sleeves 102 are removed by pulling them out through the respective apertures, leaving behind a channel 108, which sealingly communicates between each aperture 70 through 73, and its associated flow tube 34 through 37, as shown in FIG. 7. This permits the use of rigid access tubes, while providing a well-sealed connection between the spindle apertures and the tubes. The rigid tubes avoid kinking and constriction of flow, which might be found in flexible plastic tubes.

The vinyl chloride tubes 102 are particularly nonadherent to the silicone potting compound, and thus may be easily removed by pulling.

Centrifuge bag 24 defines, as shown in FIG. 9, an interior which in turn is generally parabolic in shape at one end 110. Inlet tube 26 extends the length of the bag to communicate with the interior adjacent end 110.

Bag 24 is also normally in flat configuration, comprising a pair of plasticized polyvinylchloride sheets, or other blood compatible, flexible plastic, sealed together about its periphery along heat seal 112 in a manner similar to the conventionally known blood bags.

Figure 12:
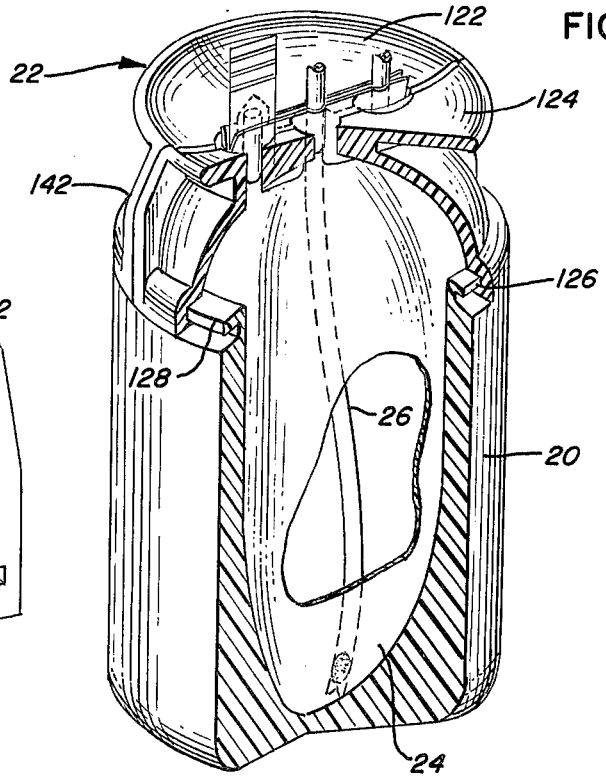
FIG. 12 is a perspective view of a centrifuge cup holding a collapsible bag and closed with the cap member of this invention.

Bag 24 is therefore inserted flat into inner centrifuge cup 20, which may be of oval inner configuration, tapering into a rounded end as shown in FIGS. 4 and 12. Because of the shape utilized herein, upon inflation of bag 24 within cup 20, fewer wrinkles are provided, which retain blood and interfere with the washing of blood cells.

Bag 24 also defines a hanger portion 114, which may be a punched-out portion in the heat-sealed periphery 112, to permit inverted hanging of bag 24. A conventional sealed access port 116 is provided to permit connection with a blood administration set. If desired, access port 116 may be positioned in opposite, off-center relationship to hanger member 114, so that upon inversion of bag 24 by hanging, the corner of bag 24 which carries access port 116 will be the downwardmost point of the bag, for the convenient draining of all fluids therein.

Inlet tube 26 may be attached by a spot seal 118 to the bag wall, so that tube 36 does not tend to float upwardly away from the vicinity of end 110 while the bag is filled with liquid. If tube 26 is sufficiently stiff, this expedient is not necessary.

Hanger holes 120 are also provided in the heat seal 112 to engage with pins on cap 22 for retention of the bag, to prevent its collapse during centrifugation into the centrifuge cup 20.

Cap 22 is shown to be made up of a pair of separable cap member halves 122, 124, which may be of identical configuration. The cap member halves each define semi-circular grooves 126 so that they can slide into interlocking relationship with a portion of flange 128, carried by centrifuge cup 20. Accordingly, when the mating cap halves are brought together on centrifuge cup 20, they form a retentive unit which can only be taken apart by sliding cap halves 122, 124 sideways for removal.

Cap halves 122, 124 also each define a pin 130 and a socket 132, positioned asymmetrically so that each pin 130 can mate with the corresponding socket 132 of an identical cap half when the cap halves 122, 124 are brought together on centrifuge cup 20.

Figure 10:
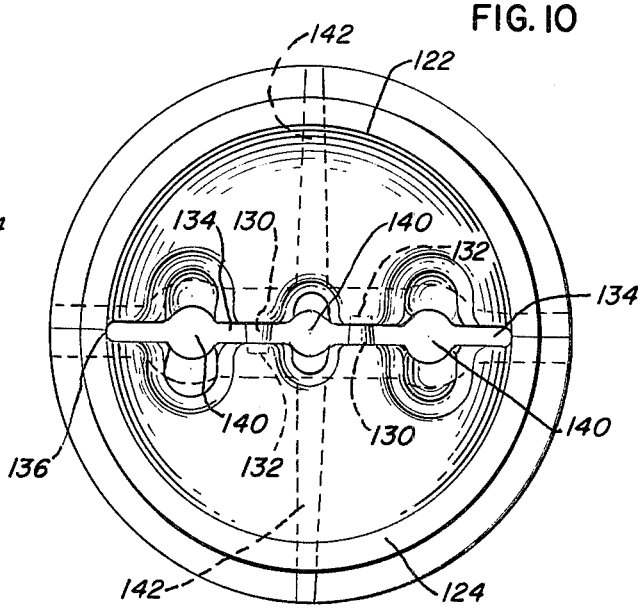
FIG. 10 is a detailed, plan view of the top of the centrifuge cup as in this invention, utilizing the centrifuge cap described herein.
Figure 11:
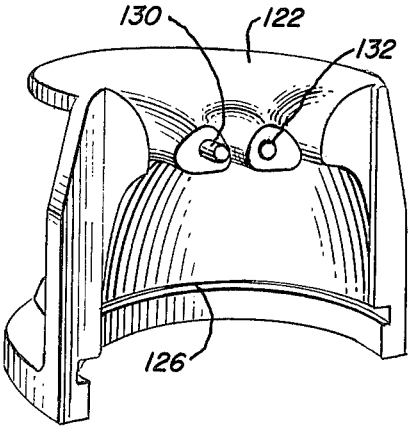
FIG. 11 is a perspective view of a centrifuge cap member half utilized in this invention.

The mating cap halves are also proportioned to provide a slot 134 (FIG. 10) between them, having generally closed ends 136, to receive the upper sealed portion 138 of bag 24. In particular, pins 130 are proportioned to pass through apertures 120 of bag 24, to retain the bag in extended position to prevent its collapse into centrifuge cup 20 upon centrifugation.

Apertures 140 are defined by enlarged portions of slot 134, to permit penetration of the three communication members 26, 30, and 116, which pass through the upper sealed portion 138 of bag 24.

Cap halves 122, 124 also may define reinforcing veins 142 as desired to reinforce the structure from the stresses encountered during centrifugation.

After assembly of the cap halves 122, 124 in removable, interlocking connection with the rim of inner centrifuge cup 20, with bag 24 being retained therein, the entire assembly, as shown in FIG. 12, may be inserted into an outer cup 18 of a centrifuge, the outer cup being carried by rotor 16. The device is assembled as shown in FIG. 1 and described herein, and centrifugation takes place after a unit of blood has been inserted into each centrifuge bag.

While blood cell washing is being accomplished, wash solution passing into each container by inlet lines **26, 26*a* percolates through the cells which are held adjacent parabolic ends 110 of each bag in a radially outward position because of the slightly greater density of the blood cells when compared with the wash solution. During centrifugation the wash solution percolates through the blood cells, and then passes upwardly and radially inwardly to exit through outlet lines 30, 30*a***.

When the blood cells are sufficiently washed, they may be resuspended with normal saline solution, which enters the system by the same route as the wash solution. Then, the centrifuge cups 20 may be removed from the centrifuge. Lines **30, 30*a*, 26, and 26*a* may be clamped and sealed at a location outside of each of the outside of each of the bags, and then severed in a conventional manner. When needed, a conventional blood administration set may then be connected with the interior of bags 24 through access ports 116**, and the contents may be administered to patients.

The above has been offered for illustrative purposes only, and is not for the purpose of limiting the invention of this application, which is as defined in the claims below.

That which is claimed is:

1. In combination with a centrifuge cup having a mouth-defining rim, the improvement comprising:

a pair of separable cap member halves carried at the rim of said centrifuge cup and positioned together to define a cap over the mouth of said cup, and means, associated with said cap member halves for gripping the upper end of a flexible bag positioned in said cup to prevent the bag from collapsing in said cup upon centrifugation, and in which said gripping means includes pins carried by said cap member halves and proportioned to pass through and retain a flexible bag adjacent to its upper end while the bag is positioned in said centrifuge cup.

2. The combination of claim 1 in which said cap member halves define means for removable interlocking connection with the rim of said cup.

3. The combination of claim 2 in which said cap defines aperture means to permit the installment of flow tubing therethrough.

4. The combination of claim 3 including a blood cell washing bag positioned in said cup and gripped at its upper end by said gripping means.

5. The combination of claim 4 in which said cell washing bag comprises a pair of heat-sealed plastic sheets sealed together at their edges, and an inlet and outlet tube passing through said heat-sealed edge and passing through said cap to provide communication with the interior of said bag.

6. The combination of claim 5 in which said bag, in its initial form is generally flat, the end of the bag interior adjacent the bottom of said cup being generally parabolic in shape.

7. The combination of claim 6 in which the interior of said cup is of oval cross-section and tapers to a rounded bottom, to accomodate the shape of said bag when expanded out of its flattened, initial condition with a minimum of wrinkles.

8. A cap member half, separably matable with another cap member half to form a cap for a centrifube cup which includes pin means protruding from an upper portion of said cap member half, for passing through an upper portion of a flexible bag positionable in a centrifuge cup, said pin means being further adapted for passing into a socket of a mating cap member half, to prevent said bag from collapsing in the cup upon centrifugation, and means, positioned adjacent the lower end of said cap member half, for removable interlocking connection with a rim of a centrifuge cup.

9. A collapsible bag for the washing of blood cells, said bag being generally flat in its initial configuration, said bag defining an interior, one end of which is generally parabolic in shape, an inlet tube and an outlet tube passing in sealed manner into said bag at an end opposite to said one end, said inlet tube extending into the bag interior and terminating adjacent said one end, said bag including a third sealed access port at said opposite end for access to blood cells after centrifugation and washing, and a hanger member positioned adjacent at said one end to permit said bag to be hung with the opposite end pointed downwardly, in which said inlet tube is attached to an interior wall of said bag at a point spaced from the entrance of said tube into the bag, to hold said inlet tube in a predetermined position.

10. The cell washing bag of claim 9 in which said hanger member is positioned adjacent said one end in off-center relationship thereto.

11. The bag of claim 10 in which said sealed access port is positioned in off-center relationship to the longitudinal axis of said bag on a side opposite to the position of said hanger member.

12. The bag of claim 10 in which said bag is defined by a pair of plastic sheets, heat sealed at their periphery, the heat sealed periphery adjacent said opposite end defining aperture means to permit retentive engagement of the opposite end of said bag by a cap, when said bag is positioned in a centrifuge cup.

* * * * *